US006491463B1

(12) United States Patent
Richard

(10) Patent No.: US 6,491,463 B1
(45) Date of Patent: Dec. 10, 2002

(54) FLUID APPLICATOR SYSTEM

(76) Inventor: Patricia A. Richard, 2317 Stingray Dr., Lake Charles, LA (US) 70605

( * ) Notice: Subject to any disclaimer, the term of this patent is extended or adjusted under 35 U.S.C. 154(b) by 0 days.

(21) Appl. No.: 10/093,465

(22) Filed: Mar. 8, 2002

(51) Int. Cl.[7] ..... A46B 5/02

(52) U.S. Cl. ..... 401/6; 401/23; 401/136; 401/186; 401/205; 401/207; 401/270

(58) Field of Search ..... 401/6, 23, 136, 401/186, 205, 207, 270, 277; 222/464.5, 523; D4/114, 137; D28/7

(56) References Cited

U.S. PATENT DOCUMENTS

| | | | | |
|---|---|---|---|---|
| 2,119,646 A | * | 6/1938 | Pidel | 401/207 |
| 3,106,741 A | * | 10/1963 | Stoner | 401/183 |
| 4,961,661 A | | 10/1990 | Sutton et al. | |
| 5,353,819 A | | 10/1994 | Kahn et al. | |
| D374,741 S | | 10/1996 | Devereaux | |
| 5,699,574 A | | 12/1997 | Oviatt | |
| 5,908,256 A | | 6/1999 | Bernstein | |
| 5,931,591 A | | 8/1999 | McCracken | |

* cited by examiner

*Primary Examiner*—Gregory Huson
*Assistant Examiner*—Tuan Nguyen

(57) ABSTRACT

A fluid applicator system includes a container member that has a bottom wall and a perimeter wall that extend upwardly from the bottom wall. The bottom wall and the perimeter wall define an interior space. The container member has top portion coupled to the perimeter wall. The top portion has an aperture that extends therethrough. The container member is for storing a fluid to be applied. An extension member is substantially hollow and elongate. The extension member has an interior in environmental communication with the interior space of the container member. An applicator assembly is operationally coupled to the extension member such that fluid stored in the container member is flowable through the extension member to an exterior surface of the applicator assembly, the applicator assembly is for applying the fluid to skin of a user.

10 Claims, 3 Drawing Sheets

FLUID APPLICATOR SYSTEM

BACKGROUND OF THE INVENTION

1. Field of the Invention

The present invention relates to fluid applicator systems and more particularly pertains to a new fluid applicator system for providing a convenient means of applying suntan oil, lotions, body wash, medicinal rubs, or sunscreen.

2. Description of the Prior Art

The use of fluid applicator systems is known in the prior art. U.S. Pat. No. 5,908,256 describes a bottle with built-in telescoping applicator head and valve for applying a liquid. Another type of fluid applicator system is U.S. Pat. No. 4,961,661 describes a extendable fluid applicator. U.S. Pat. No. 5,353,819 describes a lotion wand for dispensing suntan lotion. U.S. Pat. No. 5,699,574 describes an extendable applicator having and extendable handle. U.S. Pat. No. 5,931,591 describes a lotion applicator for applying lotion to the skin and particularly to the back and legs of a user. U.S. Pat. No. Des. 374,741 describes a design for a hair dye applicator.

While these devices fulfill their respective, particular objectives and requirements, the need remains for a device that includes a design that allows the user to adjust level of fluid that reaches the applicator pad and the air flow return to the bottle.

SUMMARY OF THE INVENTION

The present invention meets the needs presented above by incorporating a fluid and air control adjustment assembly.

Still yet another object of the present invention is to provide a new fluid applicator system that would reduce the mess associated with applying liquids and prevent waste while applying liquids, thus saving the user money.

Even still another object of the present invention is to provide a new fluid applicator system that would eliminate the user form asking for assistance when applying a liquid, especially when applying to their back and other hard to reach areas.

To this end, the present invention generally comprises a container member that has a bottom wall and a perimeter wall that extend upwardly from the bottom wall. The bottom wall and the perimeter wall define an interior space. The container member has top portion coupled to the perimeter wall. The top portion has an aperture that extends therethrough. The container member is for storing a fluid to be applied. An extension member is substantially hollow and elongate. The extension member has an interior in environmental communication with the interior space of the container member. An applicator assembly is operationally coupled to the extension member such that fluid stored in the container member is flowable through the extension member to an exterior surface of the applicator assembly, the applicator assembly is for applying the fluid to skin of a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
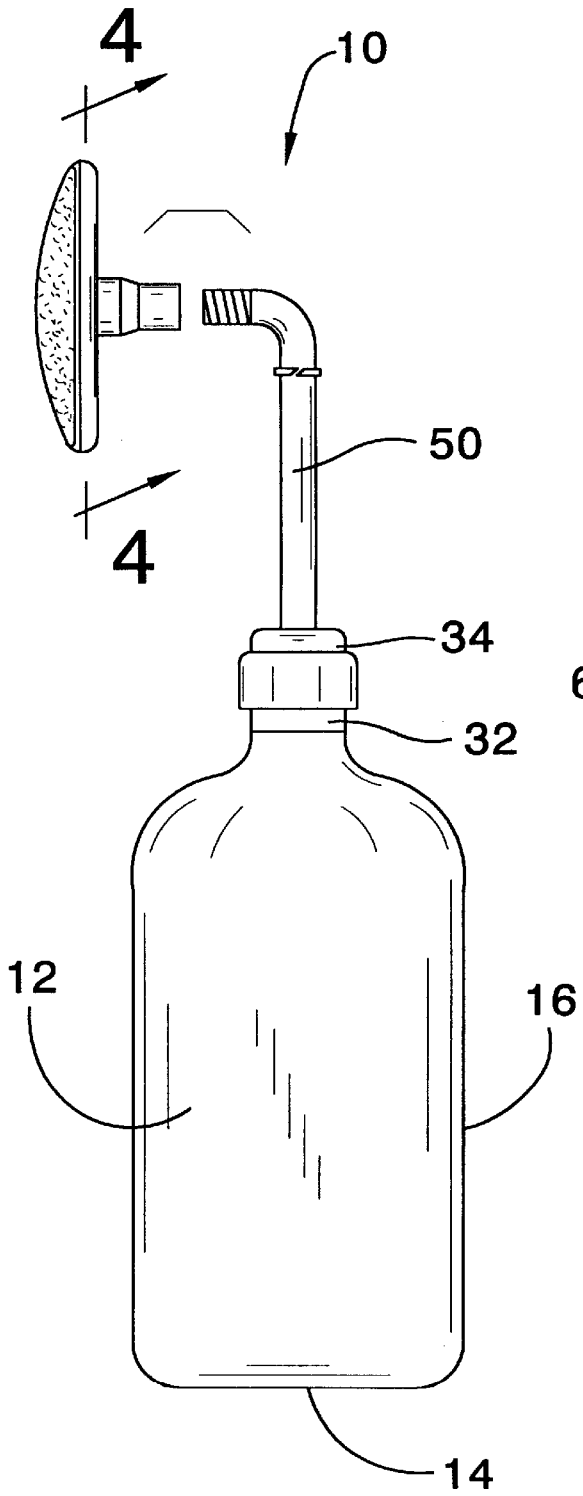
FIG. 1 is a side view of a new fluid applicator system according to the present invention.
Figure 4:
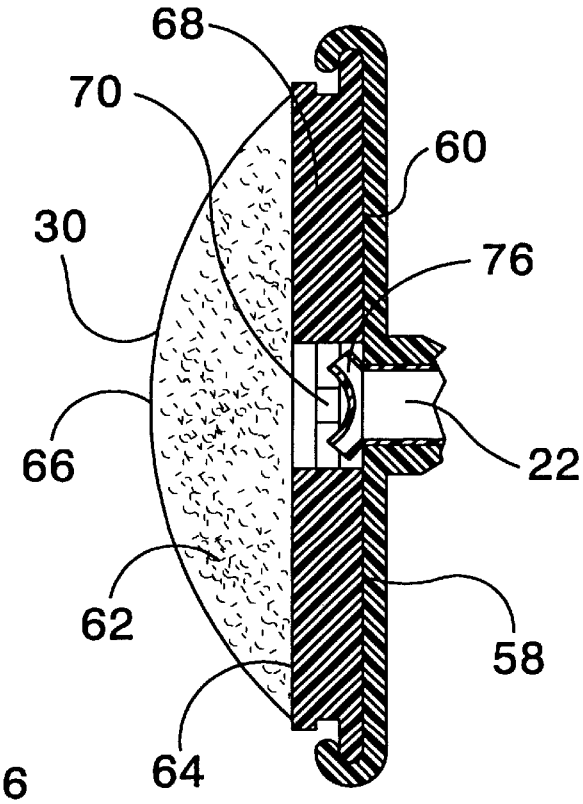
FIG. 4 is a cross-sectional view of the present invention.
Figure 2:
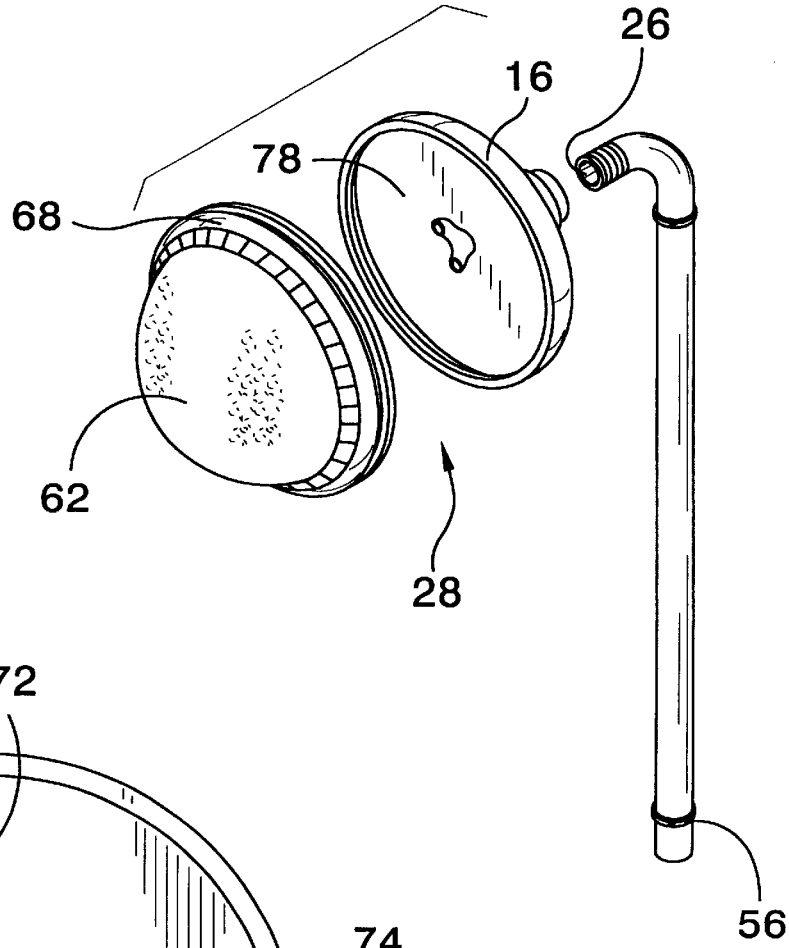
FIG. 2 is a perspective view of the present invention.
Figure 3:
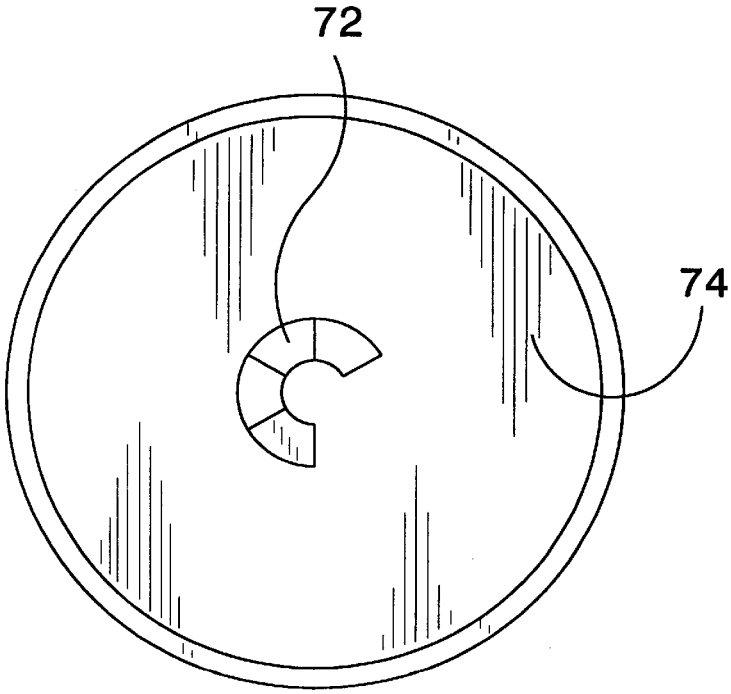
FIG. 3 is a front view of the present invention.
Figure 5:
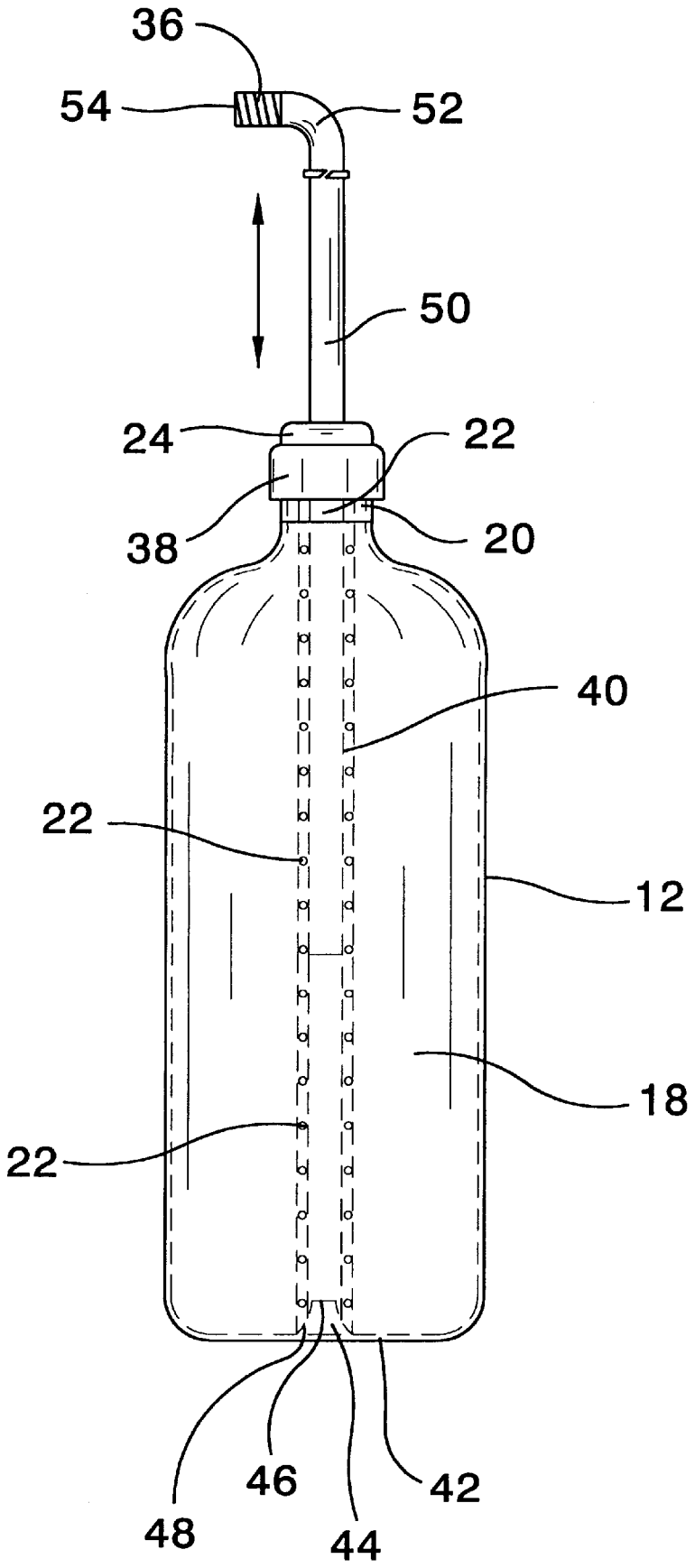
FIG. 5 is a side view of the present invention.

With reference now to the drawings, and in particular to FIGS. 1 through 5 thereof, a new fluid applicator system embodying the principles and concepts of the present invention and generally designated by the reference numeral 10 will be described.

As best illustrated in FIGS. 1 through 5, the fluid applicator system 10 generally comprises a container member 12 that has a bottom wall 14 and a perimeter wall 16 that extend upwardly from the bottom wall 14. The bottom wall 14 and the perimeter wall 16 define an interior space 18. The container member 12 has top portion 20 coupled to the perimeter wall 16. The top portion 20 has an aperture 22 that extends therethrough. The container member 12 is for storing a fluid to be applied. An extension member 24 is substantially hollow and elongate. The extension member 24 has an interior 26 in environmental communication with the interior space 18 of the container member 12. An applicator assembly 28 is operationally coupled to the extension member 24 such that fluid stored in the container member 12 is flowable through the extension member 24 to an exterior surface 30 of the applicator assembly 28, the applicator assembly 28 is for applying the fluid to skin of a user.

A flange portion 32 extends upwardly around a perimeter edge 34 of the aperture 22. The flange portion 32 has threads 36 applied thereon. The flange portion 32 is for facilitating closing the container member 12. A cap member 38 is threadedly couplable to the flange portion 32 the cap member 38 is for closing the container member 12. The cap member 38 has an aperture 22 that extends therethrough for slidably receiving the extension member 24. The cap member 38 is for facilitating filling the container member 12.

A tube portion 40 extends from the aperture 22 into the interior space 18 of the container member 12. The tube portion 40 has a plurality of apertures 22 deployed in a linear array along a surface of the tube portion 40. The tube portion 40 is for slidably receiving the extension member 24 such that when the extension member 24 is placed in a stored position the interior on the container member 12 is closed by an exterior surface 30 of the extension member 24 abutting an interior surface of the tube portion 40.

A gasket member 44 is coupled to an interior surface 42 of the bottom wall 14. The gasket member 44 is positioned such that a center 46 of the gasket member 44 is substantially collinear with a longitudinal axis of the container member 12. The gasket member 44 is for closing a first end 48 of the tube portion 40.

A first extent 50 is slidably coupled to the container member 12 the first extent 50 has a longitudinal axis. The first extent 50 is positioned such that the longitudinal axis is substantially collinear with a longitudinal axis of the container member 12, the first extent 50 is substantially hollow.

A second extent 52 is integrally coupled to the first extent 50. The second extent 52 has a longitudinal axis. The second extent 52 is portioned such that the longitudinal axis of the second extent 52 has a angular relationship with the longitudinal axis of the first extent 50. The second extent 52 is substantially hollow. An interior of the second extent 52 is in environmental communication with an interior of the first extent 50. The second extent 52 is for spacing the applicator assembly 28 away from the container member 12 to facilitate application of the fluid. The second extent 52 has a distal end 54 that has threads 36 applied thereon. The applicator assembly 28 is threadedly coupled to the distal end 54 such that the fluid is flowable through the extension member 24 into an interior of the applicator assembly 28.

A clip member 56 is coupled to the first extent 50. The clip member 56 is for applying a compressive force to a perimeter wall of the first extent 50 such that an interior of the extension member 24 is closeable by the clip member 56.

A base member 58 is couplable to the extension member 24. The base member 58 has a main wall 60 with an aperture 22 that extends therethrough. The base member 58 has a perimeter wall 16 for extending upwardly from the main wall 60. An applicator pad member 62 has a first surface 64 positionable in a spaced relationship with the main wall 60. The applicator pad 62 has a second surface 66 for contacting the skin of the user. The applicator pad 62 is substantially porous for facilitating flow of the fluid through the applicator pad 62. A coupling ring member 68 is for securing the applicator pad 62 to the base member 58. The coupling ring 68 engaging a perimeter edge 34 of the applicator pad 62. A fluid distributing portion 70 is for facilitating distribution of the fluid over a broader area of the first surface 64 of the applicator pad 62.

A flow control portion 72 is coupled to the coupling ring member 68. The flow control portion 72 has a first disk 74 that is fixedly coupled to the coupling ring member 68. The first disk 74 has an arcuate channel 76 positioned medially. The flow control portion 72 has a second disk 78 rotatably coupled to the coupling ring member 68. The second disk 78 has a second arcuate channel positioned medially. The first arcuate channel 76 is alignable with the second arcuate channel forming a bore of variable length through the flow control portion 72 such that a restriction of the fluid flowing through the flow control portion 72 onto the first surface64 of the applicator assembly 28 is controlled.

In use, the user would pour a quantity of liquid within the interior of the bottle. The applicator pad could be secured to the end of the tube through twisting and turning. Next, the bottle would be tilted and squeezed which would cause the liquid to flow from the applicator pad. The applicator pad would then be moved over the desired area. The applicator pad could be replace when it became worn or dirty.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fluid applicator system for use by a single person, comprising:

a container member having a bottom wall and a perimeter wall extending upwardly from said bottom wall, said bottom wall and said perimeter wall defining an interior space, said container member having a top portion coupled to said perimeter wall, said top portion having an aperture extending therethrough, said container member being for storing a fluid to be applied;

an extension member being substantially hollow and elongate, said extension member having an interior in environmental communication with said interior space of said container member;

a tube portion extending from said aperture into said interior space of said container member, said tube portion having a plurality of apertures deployed in a linear array along a surface of said tube portion, said tube portion being for slidably receiving said extension member such that when said extension member being placed in a stored position said interior on said container member is closed by an exterior surface of said extension member abutting an interior surface of said tube portion;

a gasket member coupled to an interior surface of said bottom wall, said gasket member being positioned such that a center of said gasket member is substantially collinear with a longitudinal axis of said container member, said gasket member being for closing a first end of said tube portion; and an applicator assembly operationally coupled to said extension member such that fluid stored in said container member is flowable through said extension member to an exterior surface of said applicator assembly, said applicator assembly being for applying the fluid to skin of a user.

2. The System of claim 1, wherein said container member further comprises:

a flange portion extending upwardly around a perimeter edge of said aperture, said flange portion having threads applied thereon, said flange portion being for facilitating closing said container member; and a cap portion being threadedly couplable to said flange portion said cap member being for closing said container member.

3. The system of claim 2, wherein said cap member having an aperture extending therethrough for slidably receiving said extension member, said cap member being for facilitating filling said container member.

4. The system of claim 1, wherein said extension member further comprises:

a first extent for slidably coupling to said container member said first extent having a longitudinal axis, said first extent being positioned such that said longitudinal axis is substantially collinear with a longitudinal axis of said container member, said first extent being substantially hollow;

a second extent integrally coupled to said first extent, said second extent having a longitudinal axis, said second extent being portioned such that said longitudinal axis of said second extent has a angular relationship with said longitudinal axis of said first extent, said second extent being substantially hollow, an interior of said second extent being in environmental communication with an interior of said first extent, said second extent being for spacing said applicator assembly away from said container member to facilitate application of the fluid.

5. The system of claim 4, wherein said second extent having a distal end, said distal end having threads applied thereon, said applicator assembly being threadedly coupled to said distal end such that the fluid is flowable through said extension member into an interior of said applicator assembly.

6. The system of claim 4 further comprising a clip member coupled to said first extent, said clip member being for applying a compressive force to a perimeter wall of said first extent such that an interior of said extension member is closeable by said clip member.

7. The system of claim 1, wherein said applicator assembly further comprises:

a base member couplable to said extension member, said base member having a main wall with an aperture extending therethrough, said base member having a perimeter wall extending upwardly from said main wall;

an applicator pad member, said applicator pad member having a first surface positionable in a spaced relationship with said main wall, said applicator pad having a second surface for contacting the skin of the user, said applicator pad being substantially porous for facilitating flow of the fluid through said applicator pad;

a coupling ring member for securing said applicator pad to said base member, said coupling ring engaging a perimeter edge of said applicator pad.

8. The system of claim 7, further comprising a fluid distributing portion for facilitating distribution of the fluid over a broader area of said first surface of said applicator pad.

9. The system of claim 8, further comprising a flow control portion coupled to said coupling ring member, said flow control portion having a first disk, said first disk being fixedly coupled to said coupling ring member, said first disk having an arcuate channel positioned medially, said flow control portion having a second disk rotatably coupled to said coupling ring member, said second disk having a second arcuate channel positioned medially, said first arcuate channel being alignable with said second arcuate channel forming a bore of variable length through said flow control portion such that a restriction of the fluid flowing through said flow control portion onto said first surface of said applicator assembly is controlled.

10. A fluid applicator system for use by a single person, comprising:

a container member having a bottom wall and a perimeter wall extending upwardly from said bottom wall, said bottom wall and said perimeter wall defining an interior space, said container member having a top portion coupled to said perimeter wall, said top portion having an aperture extending therethrough, said container member being for storing a fluid to be applied;

an extension member being substantially hollow and elongate, said extension member having an interior in environmental communication with said interior space of said container member; and an applicator assembly operationally coupled to said extension member such that fluid stored in said container member is flowable through said extension member to an exterior surface of said applicator assembly, said applicator assembly being for applying the fluid to skin of a user;

wherein a flange portion extending upwardly around a perimeter edge of said aperture, said flange portion having threads applied thereon, said flange portion being for facilitating closing said container member; and a cap portion being threadedly couplable to said flange portion said cap member being for closing said container member;

wherein said cap member having an aperture extending therethrough for slidably receiving said extension member, said cap member being for facilitating filling said container member;

wherein a tube portion extending from said aperture into said interior space of said container member, said tube portion having a plurality of apertures deployed in a linear array along a surface of said tube portion, said tube portion being for slidably receiving said extension member such that when said extension member being placed in a stored position said interior on said container member is closed by an exterior surface of said extension member abutting an interior surface of said tube portion; and a gasket member coupled to an interior surface of said bottom wall, said gasket member being positioned such that a center of said gasket member is substantially collinear with a longitudinal axis of said container member, said gasket member being for closing a first end of said tube portion;

wherein a first extent for slidably coupling to said container member said first extent having a longitudinal axis, said first extent being positioned such that said longitudinal axis is substantially collinear with a longitudinal axis of said container member, said first extent being substantially hollow;

a second extent integrally coupled to said first extent, said second extent having a longitudinal axis, said second extent being portioned such that said longitudinal axis of said second extent has a angular relationship with said longitudinal axis of said first extent, said second extent being substantially hollow, an interior of said second extent being in environmental communication with an interior of said first extent, said second extent being for spacing said applicator assembly away from said container member to facilitate application of the fluid;

wherein said second extent having a distal end, said distal end having threads applied thereon, said applicator assembly being threadedly coupled to said distal end such that the fluid is flowable through said extension member into an interior of said applicator assembly;

wherein a clip member coupled to said first extent, said clip member being for applying a compressive force to a perimeter wall of said first extent such that an interior of said extension member is closeable by said clip member;

wherein a base member couplable to said extension member, said base member having a main wall with an aperture extending therethrough, said base member having a perimeter wall extending upwardly from said main wall;

an applicator pad member, said applicator pad member having a first surface positionable in a spaced relationship with said main wall, said applicator pad having a second surface for contacting the skin of the user, said applicator pad being substantially porous for facilitating flow of the fluid through said applicator pad;

a coupling ring member for securing said applicator pad to said base member, said coupling ring engaging a perimeter edge of said applicator pad;

wherein a fluid distributing portion for facilitating distribution of the fluid over a broader area of said first surface of said applicator pad;

wherein a flow control portion coupled to said coupling ring member, said flow control portion having a first disk, said first disk being fixedly coupled to said coupling ring member, said first disk having an arcuate channel positioned medially, said flow control portion having a second disk rotatably coupled to said coupling ring member, said second disk having a second arcuate channel positioned medially, said first arcuate channel being alignable with said second arcuate channel forming a bore of variable length through said flow control portion such that a restriction of the fluid flowing through said flow control portion onto said first surface of said applicator assembly is controlled.

* * * * *